US011450289B2

(12) United States Patent
Ahn et al.

(10) Patent No.: US 11,450,289 B2
(45) Date of Patent: Sep. 20, 2022

(54) DISPLAY DEVICE AND METHOD OF PROTECTING THE SAME

(71) Applicant: Samsung Display Co., Ltd., Yongin-Si (KR)

(72) Inventors: Gwangsoo Ahn, Suwon-si (KR); Jong Jae Lee, Hwaseong-si (KR); Sungsoo Choi, Gyeonggi-do (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/387,235

(22) Filed: Jul. 28, 2021

(65) Prior Publication Data

US 2022/0148531 A1 May 12, 2022

(30) Foreign Application Priority Data

Nov. 11, 2020 (KR) ..... 10-2020-0150411

(51) Int. Cl.
*G09G 3/36* (2006.01)

(52) U.S. Cl.
CPC ..... *G09G 3/36* (2013.01); *G09G 2330/021* (2013.01); *G09G 2330/045* (2013.01)

(58) Field of Classification Search
CPC ..... G09G 3/2092; G09G 3/2096; G09G 3/36; G09G 3/3611; G09G 3/3655; G09G 3/3674; G09G 3/3677; G09G 3/3681; G09G 3/3696; G09G 5/003; G09G 5/005; G09G 5/006; G09G 5/008; G09G 2310/0202; G09G 2310/0243; G09G 2310/08; G09G 2330/02; G09G 2330/021; G09G 2330/025; G09G 2330/026; G09G 2330/027; G09G 2330/028; G09G 2330/04; G09G 2330/045; G09G 2330/12; H02H 3/08; H02H 3/093; H02H 7/20
See application file for complete search history.

(56) References Cited

U.S. PATENT DOCUMENTS 5,224,010 A * 6/1993 Tran ..... G06F 1/28 361/90
2012/0293562 A1* 11/2012 Park ..... G09G 3/3233 345/690

(Continued)

FOREIGN PATENT DOCUMENTS

KR 10-2015-0081867 A 7/2015
KR 10-2017-0122891 A 11/2017

(Continued)

*Primary Examiner* — Keith L Crawley
(74) *Attorney, Agent, or Firm* — Innovation Counsel LLP

(57) ABSTRACT

A display device includes a display panel including a gate line, a data line, a gate driver outputting a gate signal to the gate line, a data driver outputting a data voltage to the data line and a power voltage generator. The power voltage generator generates a gate-on voltage, a gate-off voltage, and a gate clock signal toggled between the gate-on voltage and the gate-off voltage, detects a current level of a gate clock current, cuts off power of the display device when a count of the gate clock current higher than or equal to a first current level is greater than or equal to a reference count, and cuts off the power of the display device when the gate clock current is higher than or equal to a second current level higher than the first current level in an initial frame after the display device is turned on.

16 Claims, 7 Drawing Sheets

(56) References Cited

U.S. PATENT DOCUMENTS

| | | | | |
|---|---|---|---|---|
| 2015/0194800 | A1* | 7/2015 | Kim | G09G 3/3677 361/95 |
| 2017/0316728 | A1* | 11/2017 | Lee | G09G 3/3266 |
| 2018/0308448 | A1* | 10/2018 | Lee | G09G 3/3696 |
| 2019/0122611 | A1* | 4/2019 | Nam | G09G 3/3258 |
| 2019/0147783 | A1* | 5/2019 | Nam | G09G 3/3674 345/55 |
| 2020/0020265 | A1* | 1/2020 | Lee | G09G 3/20 |
| 2021/0021119 | A1* | 1/2021 | Yang | G09G 3/36 |

FOREIGN PATENT DOCUMENTS

| | | | |
|---|---|---|---|
| KR | 10-2018-0118855 | A | 11/2018 |
| KR | 10-2020-0007112 | A | 1/2020 |
| KR | 10-2020-0026522 | A | 3/2020 |
| KR | 10-2020-0042989 | A | 4/2020 |

* cited by examiner

DISPLAY DEVICE AND METHOD OF PROTECTING THE SAME

PRIORITY STATEMENT

This application claims priority under 35 U.S.C. § 119 to Korean Patent Application No. 10-2020-0150411, filed on Nov. 11, 2020, in the Korean Intellectual Property Office KIPO, the contents of which are herein incorporated by reference in their entireties.

BACKGROUND

1. Field

Embodiments of the present inventive concept relate to a display device and a method of driving the same. More particularly, embodiments of the present inventive concept relate to a display device and a method of driving the same to improve safety and reliability by detecting short circuits between gate lines or short circuits of gate lines and common electrodes.

2. Description of the Related Art

In general, the display device includes a display panel and a display panel driver. The display panel displays an image based on an input image, and includes a plurality of gate lines, a plurality of data lines, and a plurality of pixels. The display panel driver includes a gate driver providing a gate signal to the gate lines, a data driver providing a data voltage to the data lines, a driving controller for controlling the gate driver and the data driver, and a power voltage generator providing a driving voltage to the display panel, the gate driver, and the data driver.

When a short circuit occurs between signal transmission wires in a part of the display device, a user may suffer physical damage or property damage from heat generation and/or fire. Accordingly, when the short circuit occurs between the signal transmission wires in the part of the display device, the supply of power is required to be cut off.

SUMMARY

Embodiments of the present inventive concept provide a display device having improve safety and reliability by sensitively detecting short circuits between gate lines or short circuits of gate lines and common electrodes.

Embodiments of the present inventive concept also provide a method of driving a display device to improve safety and reliability by sensitively detecting short circuits between gate lines or short circuits of gate lines and common electrodes.

In an embodiment of a display device according to the present inventive concept, the display device may include a display panel, a gate driver, a data driver, and a power voltage generator. The display panel includes a gate line, a data line, and a pixel electrically connected to the gate line and the data line. The display panel is configured to display an image based on input image data. The gate driver is configured to output a gate signal to the gate line. The data driver is configured to output a data voltage to the data line. The power voltage generator is configured to generate a gate-on voltage, a gate-off voltage, and a gate clock signal toggled between the gate-on voltage and the gate-off voltage. The power voltage generator is further configured to detect a current level of a gate clock current based on the gate clock signal. The power voltage generator is further configured to cut off power of the display device when a count of the gate clock current higher than or equal to a first current level is greater than or equal to a reference count. The power voltage generator is further configured to cut off the power of the display device when the gate clock current is higher than or equal to a second current level higher than the first current level in an initial frame after the display device is turned on.

In an embodiment, the power voltage generator may simultaneously activate a first cut-off mode which cuts off the power of the display device when the count of the gate clock current higher than or equal to the first current level is greater than or equal to the reference count, and a second cut-off mode which cuts off the power of the display device when the gate clock current is higher than or equal to the second current level in the initial frame after the display device is turned on.

In an embodiment, the power voltage generator may include a voltage generator which receives a power voltage and a clock control signal, and converts and outputs the clock control signal into the gate clock signal and an overcurrent detector which detects the gate clock current flowing through a voltage terminal to output an overcurrent detection signal.

In an embodiment, the overcurrent detector may include a current sensor for sensing the gate clock current output through the voltage terminal, an overcurrent detection circuit for determining whether the gate clock current is higher than or equal to a reference current level, an overcurrent counter for counting the count of the gate clock current higher than or equal to the reference current level, and an overcurrent determination circuit for determining the gate clock current is in an overcurrent state when the count counted by the overcurrent counter is greater than equal to the reference count.

In an embodiment, the overcurrent determination circuit may activate the overcurrent detection signal when the gate clock current is determined to be in the overcurrent state.

In an embodiment, the voltage generator may cut off the power of the display device when the overcurrent detection signal is activated.

In an embodiment, the power voltage generator may detect the current level of the gate clock current behind a rising edge of the gate clock signal or a falling edge of the gate clock signal, after the gate clock signal is toggled.

In an embodiment, the power voltage generator may detect the current level of the gate clock current immediately before a rising edge of the gate clock signal or a falling edge of the gate clock signal, after the gate clock signal is toggled In an embodiment, the first current level and the second current level may be settable.

In an embodiment, the reference count may be settable.

In an embodiment of a method of driving a display device according to the present inventive concept, the method may include generating a gate-on voltage and a gate-off voltage, generating a gate clock signal toggled between the gate-on voltage and the gate-off voltage, detecting a current level of a gate clock current based on the gate clock signal, cutting off power of a display device when a count of the gate clock current higher than or equal to a first current level is greater than or equal to a reference count. The method may further include cutting off the power of the display device when the gate clock current is higher than or equal to a second current level higher than the first current level in an initial frame after the display device is turned on.

In an embodiment, a first cut-off mode which cuts off the power of the display device when the count of the gate clock current higher than or equal to the first current level is greater than or equal to the reference count, and a second cut-off mode which cuts off the power of the display device when the gate clock current is higher than or equal to the second current level in the initial frame after the display device is turned on are simultaneously activated.

In an embodiment, the cutting off of the power of the display device may further include receiving a power voltage and a clock control signal, and converting and outputting the clock control signal into the gate clock signal and detecting the gate clock current flowing through a voltage terminal and outputting an overcurrent detection signal.

In an embodiment, the outputting of the overcurrent detection signal may include sensing the gate clock current output through the voltage terminal, determining whether the gate clock current is higher than or equal to a reference current level, counting the count of the gate clock current higher than or equal to the reference current level, and determining that the gate clock current is in an overcurrent state when the count of the gate clock current higher than or equal to the reference current level is greater than equal to the reference count.

In an embodiment, the outputting of the overcurrent detection signal may further include activating the overcurrent detection signal when the gate clock current is determined to be in the overcurrent state.

In an embodiment, the converting and outputting of the clock control signal into the gate clock signal may include cutting off the power of the display device when the overcurrent detection signal is activated.

In an embodiment, the detecting of the current level of the gate clock current may include detecting the current level of the gate clock current behind a rising edge of the gate clock signal or a falling edge of the gate clock signal after the gate clock signal is toggled.

In an embodiment, the detecting of the current level of the gate clock current may further include detecting the current level of the gate clock current immediately before a rising edge of the gate clock signal or a falling edge of the gate clock signal after the gate clock signal is toggled.

In an embodiment, the first current level and the second current level may be settable.

In an embodiment, the reference count may be settable.

According to the above display device and the method of driving the same, the display device detects an abnormal current level of a gate clock current after the display device is turned on, and cuts off the power of the display device when an overcurrent occurs, so that the display device may prevent a malfunction of the display panel. In addition, the display device may prevent the display device from being heated up due to high heat, and reduce risks such as fire. As a result, the display device of the present inventive concept can improve the safety and the reliability of the display device.

DETAILED DESCRIPTION OF THE INVENTIVE CONCEPT

Hereinafter, the present inventive concept will be described in more detail with reference to the accompanying drawings.

Figure 1:
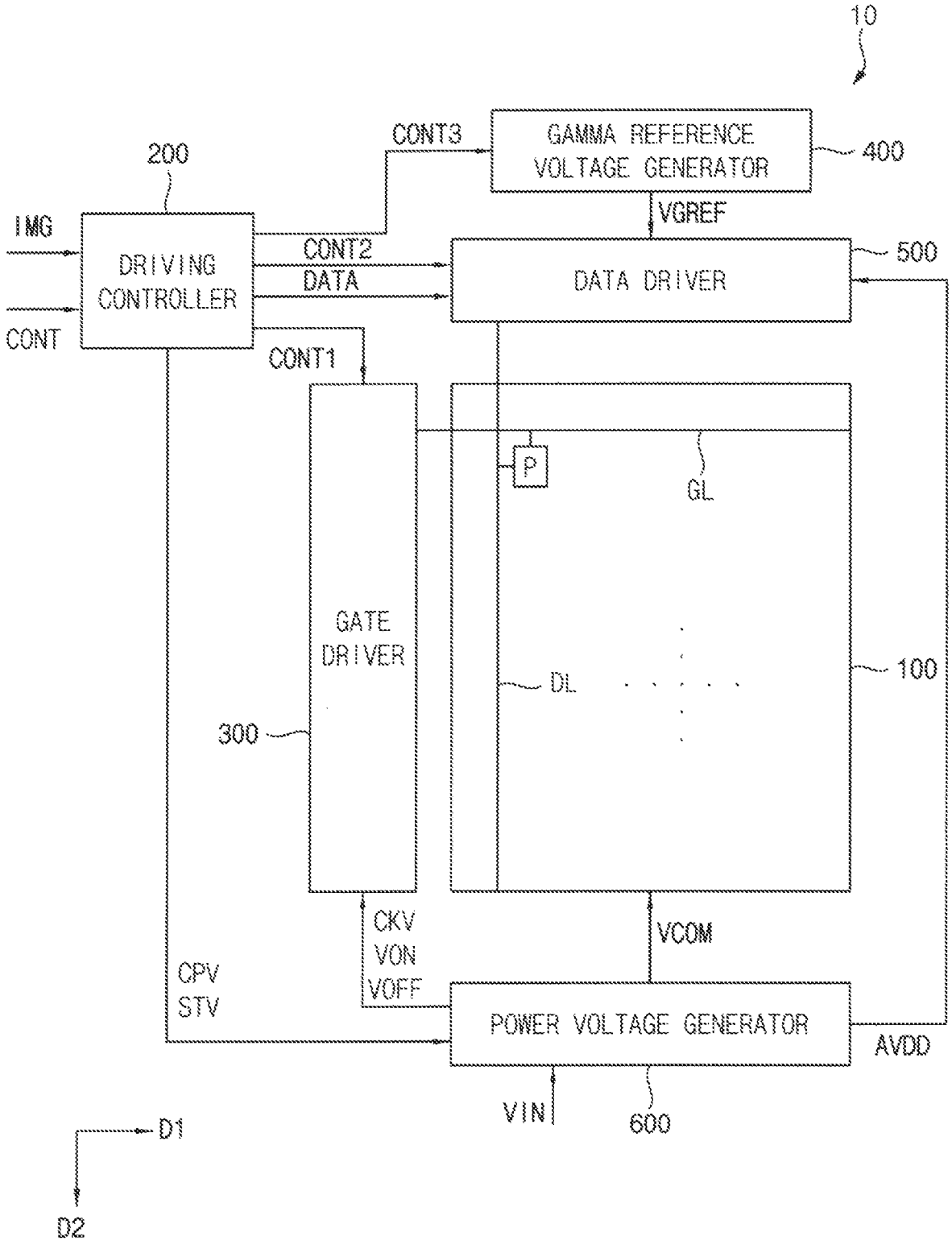
FIG. 1 is a block diagram illustrating a display device according to one embodiment of the present inventive concept.

FIG. 1 is a block diagram illustrating a display device 10 according to one embodiment of the present inventive concept.

Referring to FIG. 1, the display device 10 includes a display panel 100 and a display panel driver. The display panel driver includes a driving controller 200, a gate driver 300, a gamma reference voltage generator 400, and a data driver 500. The display panel driver may further include a power voltage generator 600.

For example, the driving controller 200 and the data driver 500 may be integrally formed with each other. For example, the driving controller 200, the gamma reference voltage generator 400, and the data driver 500 may be integrally formed with each other. A driving module in which at least the driving controller 200 and the data driver 500 are integrally formed may be referred to as a timing controller embedded data driver (TED).

The display panel 100 may include a display region for displaying an image and a peripheral region disposed adjacent to the display region.

The display panel 100 may include a plurality of gate lines GL, a plurality of data lines DL, and a plurality of pixels P electrically connected to each of the gate lines GL and the data lines DL. The gate lines GL may extend in a first direction D1, and the data lines DL may extend in a second direction D2 intersecting the first direction D1.

The driving controller 200 may receive input image data IMG and an input control signal CONT from an external device (not shown). For example, the input image data IMG may include red image data, green image data, and blue image data. The input image data IMG may include white image data. The input image data IMG may include magenta image data, yellow image data, and cyan image data. The input control signal CONT may include a master clock signal, and a data enable signal. The input control signal CONT may further include a vertical sync signal and a horizontal sync signal.

The driving controller 200 may generate a first control signal CONT1, a second control signal CONT2, a third control signal CONT3, and a data signal DATA based on the input image data IMG and the input control signal CONT.

The driving controller 200 may generate the first control signal CONT1 for controlling an operation of the gate driver 300 based on the input control signal CONT and output the first control signal CONT1 to the gate driver 300. The first control signal CONT1 may include a vertical start signal.

The driving controller 200 may generate the second control signal CONT2 for controlling an operation of the data driver 500 based on the input control signal CONT and output the second control signal CONT2 to the data driver 500. The second control signal CONT2 may include a horizontal start signal and a load signal.

The driving controller 200 may generate the data signal DATA based on the input image data IMG. The driving controller 200 may output the data signal DATA to the data driver 500.

The driving controller 200 may generate the third control signal CONT3 for controlling an operation of the gamma reference voltage generator 400 based on the input control signal CONT and output the third control signal CONT3 to the gamma reference voltage generator 400.

The gate driver 300 may generate gate signals for driving the gate lines GL in response to the first control signal CONT1 received from the driving controller 200. The gate driver 300 may output the gate signals to the gate lines GL. For example, the gate driver 300 may sequentially output the gate signals to the gate lines GL. In one embodiment, the gate driver 300 may be implemented as an amorphous silicon gate (ASG) circuit using an amorphous silicon thin film transistor (a-Si TFT), and may be mounted on a periphery of the display panel 100. In an embodiment, the gate driver 300 may be implemented using an oxide semiconductor, a crystalline semiconductor, a polycrystalline semiconductor, or the like, and may be mounted on a periphery of the display panel 100.

The gamma reference voltage generator 400 may generate a gamma reference voltage VGREF in response to the third control signal CONT3 received from the driving controller 200. The gamma reference voltage generator 400 may provide the gamma reference voltage VGREF to the data driver 500. The gamma reference voltage VGREF may have a value corresponding to each data signal DATA.

In one embodiment, the gamma reference voltage generator 400 may be disposed in the driving controller 200 or disposed in the data driver 500.

The data driver 500 may receive the second control signal CONT2 and the data signal DATA from the driving controller 200, and receive the gamma reference voltage VGREF from the gamma reference voltage generator 400. The data driver 500 may convert the data signal DATA into a data voltage having an analog format using the gamma reference voltage VGREF. The data driver 500 may output the data voltage to the data line DL. For example, the data driver 500 may be mounted on a periphery of the display panel 100. For example, the data driver 500 may be integrated on the peripheral region of the display panel 100.

The power voltage generator 600 may provide a power voltage to at least one of the display panel 100, the driving controller 200, the gate driver 300, the gamma reference voltage generator 400, and the data driver 500. At this point, the power voltage generator 600 may include a DC-DC converter. The power voltage generator 600 may generate a common voltage VCOM and output the common voltage VCOM to the display panel 100. In the embodiment, the display device 10 may be a liquid crystal display device 10 including a liquid crystal layer. However, in an embodiment, the display device 10 may be another display device other than a liquid crystal display device.

In one embodiment, the power voltage generator 600 may generate a gate clock signal CKV used for generating a gate signal, and a gate-on voltage VON and a gate-off voltage VOFF which control the operation of the gate driver 300. The power voltage generator 600 may output the gate clock signal CKV, the gate-on voltage VON and the gate-off voltage VOFF to the gate driver 300. The power voltage generator 600 may receive a gate clock control signal CPV and a vertical start signal STV from the driving controller 200. The vertical start signal STV may be a signal which indicates a start of one frame. The power voltage generator 600 may generate the gate clock signal CKV based on the gate clock control signal CPV and the vertical start signal STV. Meanwhile, the power voltage generator 600 may generate an analog high voltage AVDD for determining a level of the data voltage and output the analog high voltage AVDD to the data driver 500.

Figure 2:
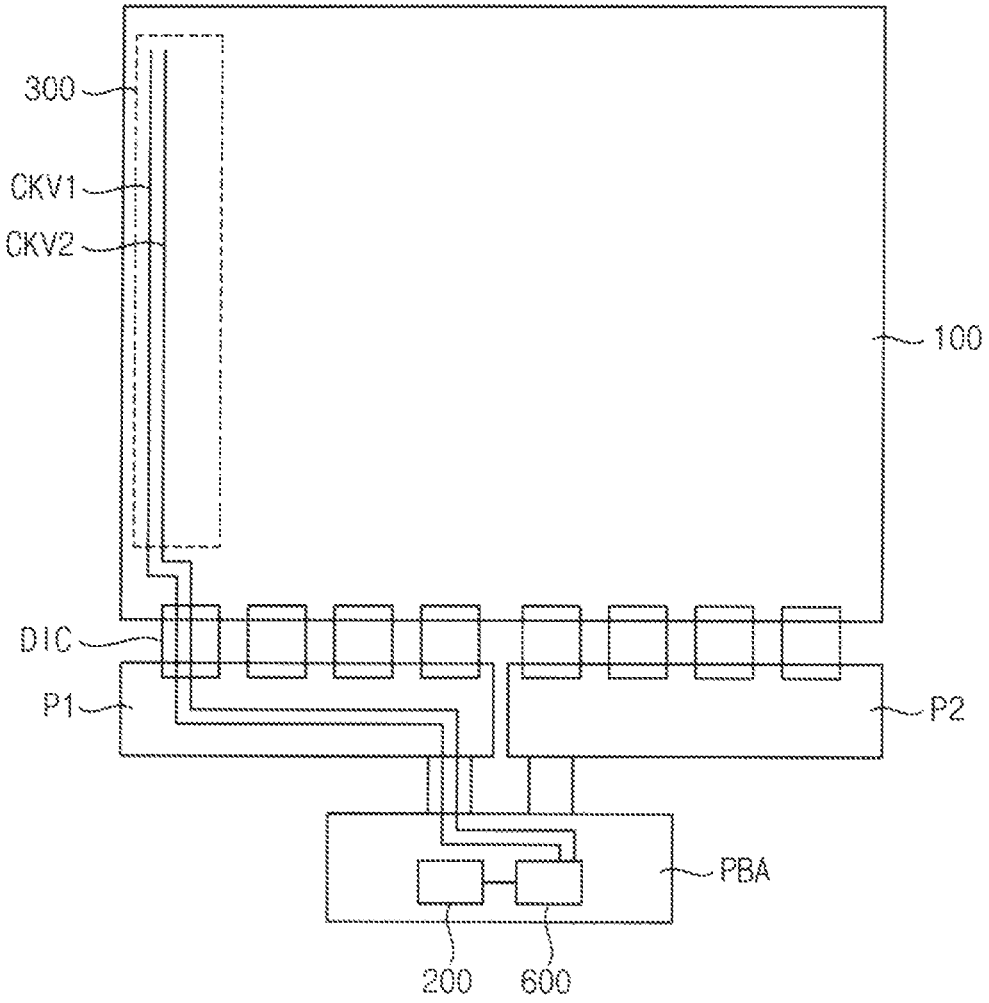
FIG. 2 is a plan view illustrating the display device of FIG. 1.

FIG. 2 is a plan view illustrating the display device 10 of FIG. 1.

Referring to FIGS. 1 and 2, the driving controller 200 and the power voltage generator 600 may be disposed in a printed circuit board assembly PBA. The printed circuit board assembly PBA may be connected to a first printed circuit P1 and a second printed circuit P2.

For example, the data driver 500 may include a plurality of data driving chips DIC connected between the first printed circuit P1 and the display panel 100, and a plurality of data driving chips DIC connected between the second printed circuit P2 and the display panel 100.

In the embodiment, the gate driver 300 may be disposed in the display panel 100. The power voltage generator 600 may output gate clock signals CKV1 and CKV2 to the gate driver 300 disposed in the display panel 100. Gate clock signal lines from which the gate clock signals CKV1 and CKV2 are applied may be disposed on the display panel 100.

Meanwhile, according to the display device 10, an adjacent gate line GL may be short-circuited, or a gate line GL and a common electrode of a first base substrate may be short-circuited, due to a problem in manufacturing or a problem of breakage while using. When the adjacent gate line GL is short-circuited or the gate line GL and the common electrode are short-circuited, the display device 10 may be heated or ignited and cause a damage to the user. In addition, even when the gate line GL and the common electrode are not short-circuited, the level of the gate clock signal CKV may significantly change due to a coupling phenomenon. Accordingly, after the gate clock signal CKV, data voltage, or the like starts to toggle, the display device 10 may be required to detect that the adjacent gate line GL is short-circuited or the gate line GL and the common electrode are short-circuited, and cut off the power of the display device 10.

The display device 10 according to the present inventive concept may detect a current level of the gate clock current based on the gate clock signal CKV, and cut off the power of the display device 10 when a count of the gate clock current higher than a first current level OCP LEVEL is more than a reference count as described below. In addition, the display device 10 may cut off the power of the display device 10 when the gate clock current is higher than a second current level ICP LEVEL higher than the first current level OCP LEVEL in an initial frame after the display device 10 is turned on as described below. Specifically, the display device 10 may simultaneously activate a first cut-off mode which cuts off the power of the display device 10 when a count of the gate clock current higher than or equal to the first current level OCP LEVEL is greater than or equal to the reference count, and a second cut-off mode which cuts off the power of the display device 10 when the gate clock current is higher than or equal to the second current level ICP LEVEL in the initial frame after the display device 10 is turned on. Thus, according to the display device 10, safety and reliability of the display device 10 may be improved by more sensitively detecting an abnormal current level of the gate clock current.

Figure 3:
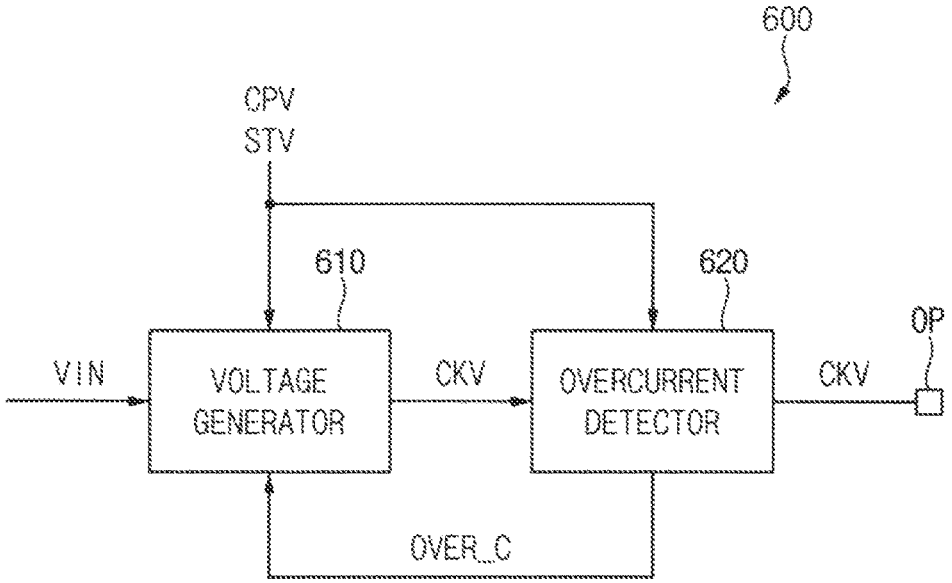
FIG. 3 is a block diagram of a power voltage generator according to one embodiment of the present inventive concept.
Figure 4:
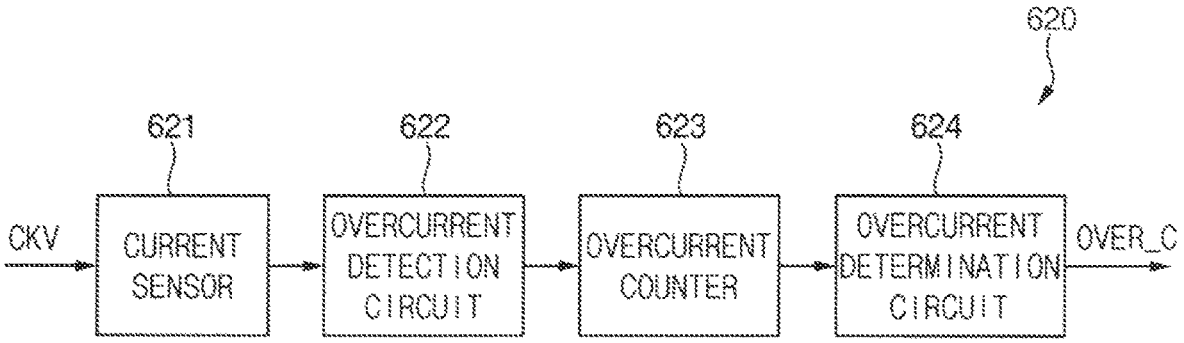
FIG. 4 is a block diagram of an overcurrent detector included in the power voltage generator of FIG. 3.

FIG. 3 is a block diagram of the power voltage generator 600 according to one embodiment of the present inventive concept. FIG. 4 is a block diagram of an overcurrent detector 620 included in the power voltage generator 600 of FIG. 3.

Referring to FIGS. 3 and 4, the power voltage generator 600 may include a voltage generator 610 and the overcurrent detector 620.

The voltage generator 610 may receive a power voltage VIN and the clock control signal CPV, sometimes called the gate clock control signal CPV, and may convert and output the clock control signal CPV into the gate clock signal CKV. The overcurrent detector 620 may detect an output current of the gate clock signal CKV flowing through a voltage terminal OP, and output an overcurrent detection signal OVER_C.

The overcurrent detector 620 may include a current sensor 621, an overcurrent detection circuit 622, an overcurrent counter 623, and an overcurrent determination circuit 624. The current sensor 621 may sense the output current of the gate clock signal CKV output through the voltage terminal OP. The overcurrent detection circuit 622 may determine whether the output current level of the gate clock signal CKV is higher than the overcurrent reference current level. The overcurrent counter 623 may count signals transmitted from the overcurrent detection circuit 622 whenever the overcurrent detection circuit 622 transmits the signals indicating that the output current level of the gate clock signal CKV is higher than the overcurrent reference current level. The overcurrent counter 623 may be initialized every predetermined period. When the count of occurrences of the overcurrent counted by the overcurrent counter 623 exceeds the reference count, the overcurrent determination circuit 624 may determine the output current of the gate clock signal CKV as an overcurrent state, and activate the overcurrent detection signal OVER_C. The voltage generator 610 may receive the overcurrent detection signal OVER_C. When the overcurrent detection signal OVER_C is activated, for example, when the overcurrent detection signal OVER_C is at a high level, the voltage generator 610 may stop the generation of internal driving voltages. In other words, the generation of driving voltages output to the voltage terminal OP is blocked, so that a malfunction of the display panel 100 shown in FIG. 1 may be prevented. In addition, product defects due to high heat can be prevented, and risks such as fire can reduced.

Figure 5:
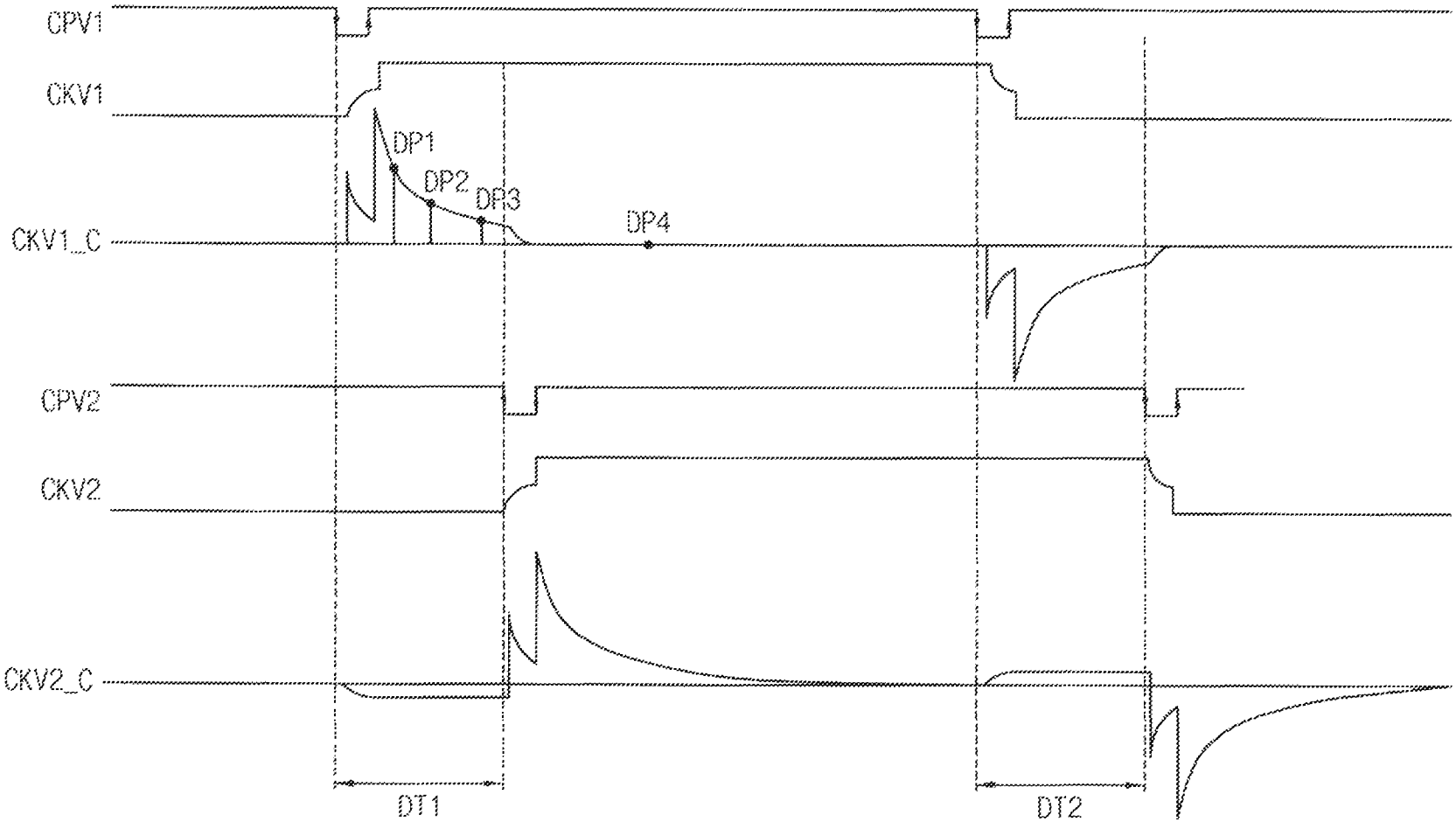
FIG. 5 is a timing diagram illustrating a gate clock control signal, a gate clock signal, and a gate clock current of a gate driver of FIG. 1.

FIG. 5 is a timing diagram illustrating gate clock control signals CPV1 and CPV2, gate clock signals CKV1 and CKV2, and gate clock currents CKV1_C and CKV2_C of the gate driver 300 of FIG. 1.

Referring to FIGS. 1 to 5, the gate clock control signals CPV1 and CPV2 may be output from the driving controller 200 to the power voltage generator 600 or the gate driver 300. The gate clock signals CKV1 and CKV2 may be synchronized with the gate clock control signals CPV1 and CPV2.

The power voltage generator 600 may determine whether the gate clock signals CKV1 and CKV2 are normal while the gate clock signals CKV1 and CKV2 are toggled between the gate-on voltage VON and the gate-off voltage VOFF (in a SCAN section).

The power voltage generator 600 according to the present inventive concept, may primarily detect the level of the gate clock signals CKV1 and CKV2 behind a rising edge of the gate clock signals CKV1 and CKV2 or a falling edge of the gate clock signals CKV1 and CKV2, after the gate clock signals CKV1 and CKV2 are toggled (in the SCAN section).

For example, FIG. 5 illustrates that the level of the first gate clock signal CKV1 is detected at a first detection point DP1, a second detection point DP2, a third detection point DP3, a fourth detection point DP4, and the like behind the rising edge of the first gate clock signal CKV1.

The power voltage generator 600 may detect the level of the gate clock signals CKV1 and CKV2 by determining whether the gate clock current CKV1_C and CKV2_C is within a normal range behind the rising edge of the gate clock signals CKV1 and CKV2 and the falling edge of the gate clock signals CKV1 and CKV2.

When the measured gate clock current CKV1_C and CKV2_C is out of the normal range, sometimes called the preset range, the display device 10 may determine that the gate clock signals CKV1 and CKV2 are at an abnormal level. In this case, the display device 10 may determine that the gate line from which the gate clock signals CKV1 and CKV2 are applied is short-circuited to another wire. In contrast, when the measured gate clock current CKV1_C and CKV2_C is within the preset range, the display device 10 may determine that the gate clock signals CKV1 and CKV2 are at the normal level.

The power voltage generator 600 according to the present inventive concept may secondarily detect the level of the gate clock signals CKV1 and CKV2 immediately before the rising edge of the gate clock signals CKV1 and CKV2 or just before the falling edge of the gate clock signals CKV1 and CKV2, after the gate clock signals CKV1 and CKV2 are toggled (in the SCAN section).

According to the embodiment, the power voltage generator 600 may determine whether the gate clock currents CKV1_C and CKV2_C are lower than a normal off level, immediately before the rising edge of the gate clock signals CKV1 and CKV2. For example, FIG. 5 illustrates the case that the second gate clock current CKV2_C is sensed immediately before the rising edge DT1 of the second gate clock signal CKV2. Since the second gate clock current CKV2_C sensed immediately before the rising edge of the second gate clock signal CKV2 is lower than the normal off level, the display device 10 may determine that the gate line from which the second gate clock signal CKV2 is applied is short-circuited to another wire.

According to the embodiment, the power voltage generator 600 may determine whether the gate clock current CKV1_C and CKV2_C is higher than the normal off level, immediately before the falling edge of the gate clock signal CKV1 and CKV2. For example, FIG. 5 illustrates the case that the second gate clock current CKV2_C is sensed immediately before the falling edge DT2 of the second gate clock signal CKV2. Since the second gate clock current CKV2_C sensed immediately before the falling edge of the second gate clock signal CKV2 is higher than the normal off level, the display device 10 may determine that the gate line from which the second gate clock signal CKV2 is applied is short-circuited to another wire.

Accordingly, the display device 10 according to the present inventive concept may primarily and secondarily sense abnormal levels of the gate clock signals CKV1 and CKV2 after the gate clock signals CKV1 and CKV2 are toggled, and detect an abnormal current level of the gate clock current CKV1_C and CKV2_C, so as to solve the problem in which the display device 10 is heated and ignited. As a result, the display device according to the present inventive concept can improve the safety and reliability of the display device 10.

Figure 6:
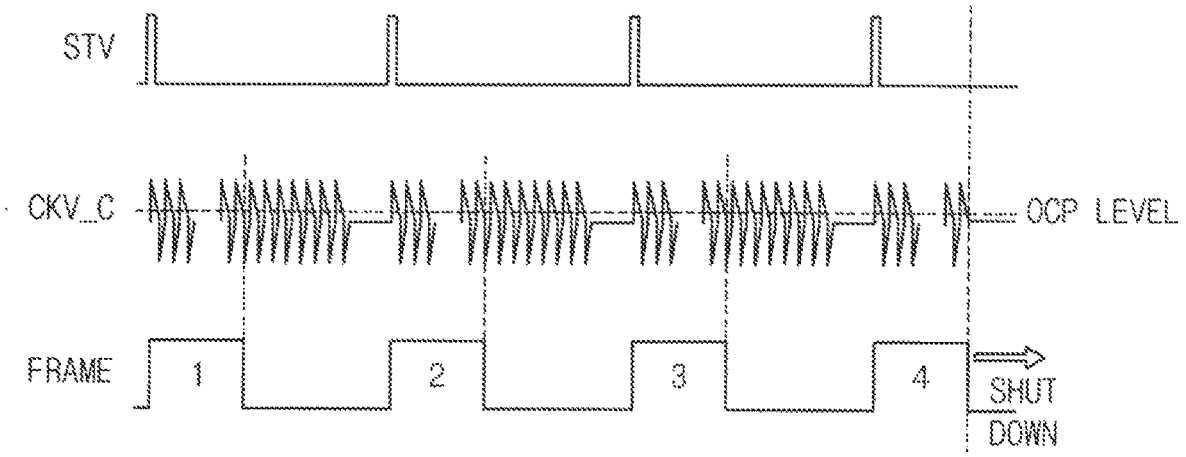
FIG. 6 is a timing diagram illustrating a cutting off process of a power voltage generator of the display device according to one embodiment of the present inventive concept.
Figure 7:
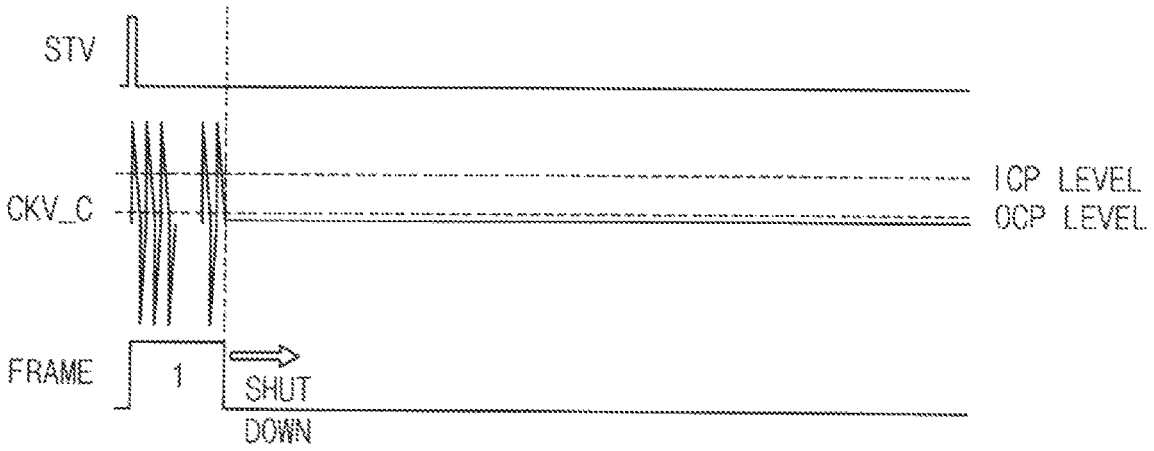
FIG. 7 is a timing diagram illustrating a cutting off process of a power voltage generator of the display device according to an embodiment of the present inventive concept.

FIG. 6 is a timing diagram illustrating a cutting off process of a power voltage generator 600 of the display device 10 according to one embodiment of the present inventive concept. FIG. 7 is a timing diagram illustrating a cutting off process of a power voltage generator 600 of the display device 10 according to an embodiment of the present inventive concept.

Referring to FIGS. 1 to 6, the power voltage generator 600 may generate a gate-on voltage, a gate-off voltage, and the gate clock signal CKV toggled between the gate-on voltage and the gate-off voltage, and may detect the current level of a gate clock current CKV_C based on the gate clock signal CKV. When a count of the gate clock current CKV_C higher than the first current level OCP LEVEL is more than a reference count, the power voltage generator 600 may cut off the power of the display device 10.

In one embodiment, the power voltage generator 600 may provide a power voltage to at least one of the display panel 100, the driving controller 200, the gate driver 300, the gamma reference voltage generator 400, and the data driver 500. Specifically, the power voltage generator 600 may generate the gate clock signal CKV used for generating a gate signal, and the gate-on voltage VON and the gate-off voltage VOFF that control the operation of the gate driver 300 and output the gate clock signal CKV, the gate-on voltage VON and the gate-off voltage VOFF to the gate driver 300. The power voltage generator 600 may receive the gate clock control signal CPV and the vertical start signal STV from the driving controller 200. The power voltage generator 600 may generate the gate clock signal CKV based on the gate clock control signal CPV and the vertical start signal STV.

In one embodiment, the power voltage generator 600 may include the voltage generator 610 and the overcurrent detector 620. The voltage generator 610 may receive the power voltage VIN and the clock control signal CPV, and convert and output the clock control signal CPV into the gate clock signal CKV. The overcurrent detector 620 may detect an output current of the gate clock signal CKV flowing through the voltage terminal OP, and output the overcurrent detection signal OVER_C. Specifically, the overcurrent detector 620 may include the current sensor 621, the overcurrent detection circuit 622, the overcurrent counter 623, and the overcurrent determination circuit 624. The current sensor 621 may sense the gate clock current CKV_C output through the voltage terminal OP. The overcurrent detection circuit 622 may determine whether the gate clock current CKV_C is higher than the overcurrent reference current level. For example, the overcurrent detection circuit 622 may determine whether the gate clock current CKV_C is higher than the first current level OCP LEVEL, and may determine that the gate clock signal CKV is at an abnormal level when the gate clock current CKV_C is greater than the first current. The overcurrent counter 623 may count signals transmitted from the overcurrent detection circuit 622 whenever the overcurrent detection circuit 622 transmits the signals indicating that the gate clock current CKV_C is higher than the overcurrent reference current level. For example, the overcurrent counter 623 may count signals transmitted from the overcurrent detection circuit 622 whenever the overcurrent detection circuit 622 transmits the signals indicating that the output current level of the gate clock current CKV_C is higher than the first current level OCP LEVEL. The overcurrent counter 623 may be initialized every predetermined period. When the count of occurrences of the overcurrent counted by the overcurrent counter 623 exceeds the reference count, the overcurrent determination circuit 624 may determine the output current of the gate clock signal CKV as an overcurrent state, and activate the overcurrent detection signal OVER_C. The reference count may be settable. For example, FIG. 6 illustrates the case that the reference count is set to 4, however, the reference count of the present inventive concept can be set to a value other than 4. The voltage generator 610 may receive the overcurrent detection signal OVER_C. When the overcurrent detection signal OVER_C is activated, for example, when the overcurrent detection signal OVER_C is at a high level, the voltage generator 610 may stop the generation of internal driving voltages. In other words, the voltage generator 610 blocks the generation of driving voltages output to the voltage terminal OP, so that the voltage generator may prevent a malfunction of the display panel 100. The voltage generator 610 may prevent the display device from being heated up due to high heat, and reduce risks such as fire.

In one embodiment, when the display device 10 is turned on, and when the gate clock current CKV_C is greater than or equal to the second current level ICP LEVEL greater than the first current level OCP LEVEL in the initial frame, the power voltage generator 600 may cut off the power of the display device 10. Referring to FIGS. 1 to 7, when the display device 10 is turned on the overcurrent detector 620 may detect an output current of the gate clock signal CKV flowing through a voltage terminal OP, and output an overcurrent detection signal OVER_C. Specifically, when the display device 10 is turned on, the current sensor 621 may sense the gate clock current CKV_C output through the voltage terminal OP. The overcurrent detection circuit 622 may determine whether the gate clock current CKV_C is higher than the second current level ICP LEVEL in the initial frame, and may determine that the gate clock signal CKV is at an abnormal level when the gate clock current CKV_C is greater than the second current. The second current level ICP LEVEL may be greater than the first current level OCP LEVEL. The overcurrent counter 623 may count signals from the overcurrent detection circuit 622 when the overcurrent detection circuit 622 transmits signals indicating that the gate clock current CKV_C is higher than the second current level ICP LEVEL in the initial frame. When the overcurrent counter 623 counts the occurrence of overcurrent higher than or equal to the second current level ICP LEVEL in the initial frame, the overcurrent determination circuit 624 may determine the output current of the gate clock signal CKV as an overcurrent state, and activate the overcurrent detection signal OVER_C. As shown in FIG. 7, when the gate clock current CKV_C is higher than or equal to the second current level ICP LEVEL in the initial frame after the display device 10 is turned on, the power voltage generator 600 may cut off the power of the display device 10. The power voltage generator 600 according to the present inventive concept may simultaneously activate a first cut-off mode that cuts off the power of the display device 10 when a count of the gate clock current CKV_C higher than or equal to the first current level OCP LEVEL is greater than or equal to the reference count, and a second cut-off mode that cuts off the power of the display device 10 when the gate clock current CKV_C is higher than or equal to the second current level ICP LEVEL in the initial frame after the display device 10 is turned on. Accordingly, the power voltage generator 600 can improve the safety and reliability of the display device 10 by more sensitively detecting the abnormal current level of the gate clock current CKV_C.

Figure 8:
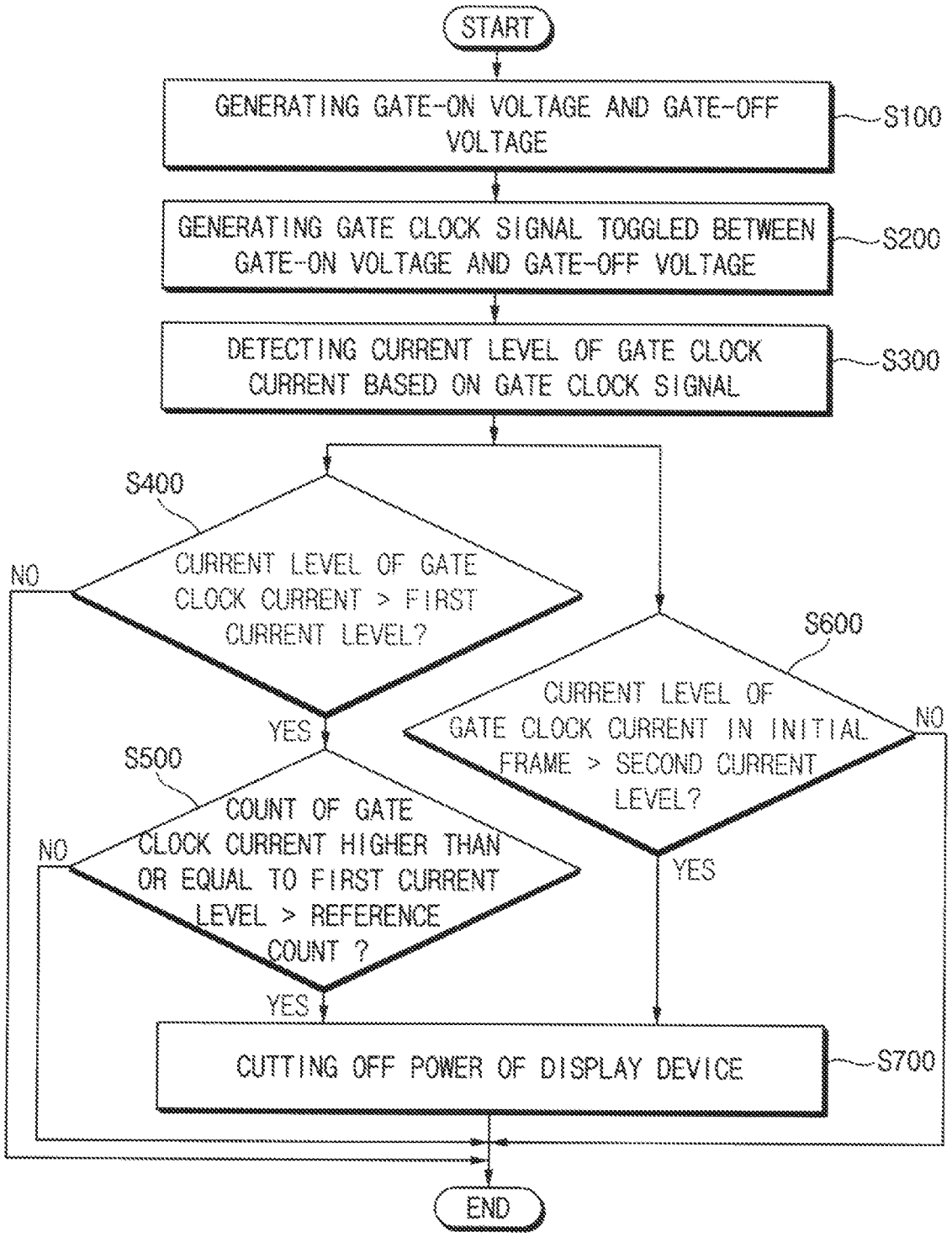
FIG. 8 is a flow chart illustrating operations of the display device according to one embodiment of the present inventive concept.

FIG. 8 is a flow chart illustrating operations of the display device 10 according to one embodiment of the present inventive concept.

Referring to FIGS. 3 to 8, the display device 10 may generate the gate-on voltage VON and the gate-off voltage VOFF in an operation S100, generate the gate clock signal CKV toggled between the gate-on voltage VON and the gate-off voltage VOFF in an operation 5200, detect a current level of the gate clock current CKV_C based on the gate clock signal CKV in an operation 5300. The display device 10 may cut off power of the display device 10 when a count the gate clock current CKV_C higher than or equal to the first current level OCP LEVEL is greater than or equal to the reference count in operations 5400, 5500, and 5700. The display device 10 may cut off the power of the display device 10 when the gate clock current CKV_C is greater than or equal to the second current level ICP LEVEL greater than the first current level OCP LEVEL in the initial frame after the display device 10 is turned on in operations 5600 and 5700.

In one embodiment, the display device 10 may generate the gate-on voltage VON and the gate-off voltage VOFF in operation S100, generate the gate clock signal CKV toggled between the gate-on voltage VON and the gate-off voltage VOFF in operation 5200, and detect a current level of the gate clock current CKV_C based on the gate clock signal CKV in operation 5300. Specifically, the power voltage generator 600 may provide a power voltage to at least one of the display panel 100, the driving controller 200, the gate driver 300, the gamma reference voltage generator 400, and the data driver 500. The power voltage generator 600 may generate the gate clock signal CKV used for generating a gate signal, and the gate-on voltage VON and the gate-off voltage VOFF that control the operation of the gate driver 300 and output the gate clock signal CKV, the gate-on voltage VON and the gate-off voltage VOFF to the gate driver 300. The power voltage generator 600 may determine whether the gate clock signal CKV is normal while the gate clock signal CKV is toggled between the gate-on voltage VON and the gate-off voltage VOFF. For example, the power voltage generator 600 may primarily detect the level of the gate clock signals CKV1 and CKV2 behind a rising edge of the gate clock signals CKV1 and CKV2 or a falling edge of the gate clock signals CKV1 and CKV2, after the gate clock signals CKV1 and CKV2 are toggled. FIG. 5 illustrates that the level of the first gate clock signal CKV1 is detected at a first detection point DP1, a second detection point DP2, a third detection point DP3, a fourth detection point DP4, and the like behind the rising edge of the first gate clock signal CKV1. The power voltage generator 600 may detect the level of the gate clock signals CKV1 and CKV2 by using whether the gate clock current CKV1_C and CKV2_C is within a normal range behind the rising edge of the gate clock signals CKV1 and CKV2 and the falling edge of the gate clock signals CKV1 and CKV2. When the measured gate clock current CKV_C and CKV2_C is out of the preset range, the display device 10 may determine that the gate clock signals CKV1 and CKV2 are at an abnormal level. In this case, the display device 10 may determine that the gate line from which the gate clock signals CKV1 and CKV2 are applied is short-circuited to another wire. In contrast, when the measured gate clock current CKV1_C and CKV2_C is within the preset range, the display device 10 may determine that the gate clock signals CKV1 and CKV2 are at the normal level. For another example, the power voltage generator 600 may secondarily detect the level of the gate clock signals CKV1 and CKV2 immediately before the rising edge of the gate clock signals CKV1 and CKV2 or just before the falling edge of the gate clock signals CKV1 and CKV2, after the gate clock signals CKV1 and CKV2 are toggled. According to the embodiment, the power voltage generator 600 may determine whether the gate clock currents CKV1_C and CKV2_C are lower than a normal off level, immediately before the rising edge of the gate clock signals CKV1 and CKV2. FIG. 5 illustrates the case that the second gate clock current CKV2_C is sensed immediately before the rising edge DT1 of the second gate clock signal CKV2. Since the second gate clock current CKV2_C sensed immediately before the rising edge of the second gate clock signal CKV2 is lower than the normal off level, the display device 10 may determine that the gate line from which the second gate clock signal CKV2 is applied is short-circuited to another wire. According to the embodiment, the power voltage generator 600 may determine whether the gate clock current CKV1_C and CKV2_C is higher than the normal off level, immediately before the falling edge of the gate clock signal CKV1 and CKV2. In addition, FIG. 5 illustrates the case that the second gate clock current CKV2_C is sensed immediately before the falling edge DT2 of the second gate clock signal CKV2. Since the second gate clock current CKV2_C sensed immediately before the falling edge of the second gate clock signal CKV2 is higher than the normal off level, the display device 10 may determine that the gate line from which the second gate clock signal CKV2 is applied is short-circuited to another wire.

Thus, the display device 10 according to the present inventive concept, may primarily and secondarily sense abnormal levels of the gate clock signals CKV1 and CKV2 to detect an abnormal current level of the gate clock current CKV1_C and CKV2_C after the gate clock signal CKV is toggled after the display device 10 is turned on, so as to solve the problem in which the display device 10 is heated and ignited. As a result, the display device of the present inventive concept can improve the safety and the reliability of the display device.

In one embodiment, when a count of the gate clock current CKV_C higher than the first current level OCP LEVEL is more than a reference count, the display device 10 may cut off the power of the display device 10 in operations 5400, 5500, and 5700. Specifically, the power voltage generator 600 may generate the gate-on voltage VON, the gate-off voltage VOFF, and a gate clock signal CKV toggled between the gate-on voltage VON and the gate-off voltage VOFF, and may detect the current level of the gate clock current CKV_C based on the gate clock signal CKV. When a count of the gate clock current CKV_C higher than the first current level OCP LEVEL is more than a reference count, the power voltage generator 600 may cut off the power of the display device 10. For example, the power voltage generator 600 may include the voltage generator 610 and the overcurrent detector 620. The voltage generator 610 may receive the power voltage VIN and the clock control signal CPV, and may convert and output the clock control signal CPV into the gate clock signal CKV. The overcurrent detector 620 may detect an output current of the gate clock signal CKV flowing through the voltage terminal OP, and output an overcurrent detection signal OVER_C. The overcurrent detector 620 may include the current sensor 621, the overcurrent detection circuit 622, the overcurrent counter 623, and the overcurrent determination circuit 624. The current sensor 621 may sense the gate clock current CKV_C output through the voltage terminal OP. The overcurrent detection circuit 622 may determine whether the gate clock current CKV_C is higher than the overcurrent reference current level. The overcurrent detection circuit 622 may determine whether the gate clock current CKV_C is higher than the first current level OCP LEVEL, and may determine that the gate clock signal CKV is at an abnormal level when the gate clock current CKV_C is greater than the first current. According to the embodiment, the first current level OCP LEVEL may be settable. For example, the first current level OCP LEVEL may be set to a level between 40 mA and 60 mA. The overcurrent counter 623 may count signals transmitted from the overcurrent detection circuit 622 whenever the overcurrent detection circuit 622 transmits the signals indicating that the gate clock current CKV_C is higher than the overcurrent reference current level. The overcurrent counter 623 may count signals transmitted from the overcurrent detection circuit 622 whenever the overcurrent detection circuit 622 transmits the signals indicating that the gate clock current CKV_C is higher than the first current level OCP LEVEL. The overcurrent counter 623 may be initialized every predetermined period. When the count of occurrences of the overcurrent counted by the overcurrent counter 623 exceeds the reference count, the overcurrent determination circuit 624 may determine the output current of the gate clock signal CKV as an overcurrent state, and activate the overcurrent detection signal OVER_C. The reference count may be settable. For example, the reference count may be set to 4. The voltage generator 610 may receive the overcurrent detection signal OVER_C. When the overcurrent detection signal OVER_C is activated, for example, when the overcurrent detection signal OVER_C is at a high level, the voltage generator 610 may stop the generation of internal driving voltages. In other words, the voltage generator 610 blocks the generation of driving voltages output to the voltage terminal OP, so that the voltage generator 610 may prevent a malfunction of the display panel 100. In addition, the voltage generator 610 may prevent the display device from being heated up due to high heat, and reduce risks such as fire.

In one embodiment, when the gate clock current CKV_C is greater than or equal to the second current level ICP LEVEL greater than the first current level OCP LEVEL in the initial frame after the display device 10 is turned on, the display device 10 may cut off the power of the display device 10 in operations 5600 and 5700. Specifically, the power voltage generator 600 may generate a gate-on voltage VON, a gate-off voltage VOFF, and a gate clock signal CKV toggled between the gate-on voltage VON and the gate-off voltage VOFF, and may detect the current level of the gate clock current CKV_C based on the gate clock signal CKV. When the display device 10 is turned on and when the gate clock current CKV_C is greater than or equal to the second current level ICP LEVEL greater than the first current level OCP LEVEL in the initial frame the power voltage generator 600 may cut off the power of the display device 10. For example, when the display device 10 is turned on, the current sensor 621 may sense the gate clock current CKV_C output through the voltage terminal OP. The overcurrent detection circuit 622 may determine whether the gate clock current CKV_C is higher than the second current level ICP LEVEL in the initial frame, and may determine that the gate clock signal CKV is at an abnormal level when the gate clock current CKV_C is greater than the second current. The second current level ICP LEVEL may be greater than the first current level OCP LEVEL. According to the embodiment, the second current level ICP LEVEL may be settable. For example, the second current level ICP LEVEL may be set to a level of 150 mA. The overcurrent counter 623 may count signals from the overcurrent detection circuit 622 when the overcurrent detection circuit 622 transmits signals indicating that the gate clock current CKV_C is higher than the second current level ICP LEVEL in the initial frame. When the overcurrent counter 623 counts the occurrence of overcurrent higher than or equal to the second current level ICP LEVEL in the initial frame the overcurrent determination circuit 624 may determine the output current of the gate clock signal CKV as an overcurrent state, and activate the overcurrent detection signal OVER_C. As shown in FIG. 7, when the gate clock current CKV_C is higher than or equal to the second current level ICP LEVEL in the initial frame after the display device 10 is turned on the power voltage generator 600 may cut off the power of the display device 10. The power voltage generator 600 according to the present inventive concept may simultaneously activate a first cut-off mode that cuts off the power of the display device 10 when a count of the gate clock current CKV_C higher than or equal to the first current level OCP LEVEL is greater than or equal to the reference count, and a second cut-off mode that cuts off the power of the display device 10 when the gate clock current CKV_C is higher than or equal to the second current level ICP LEVEL in the initial frame after the display device 10 is turned on. Accordingly, the power voltage generator 600 can improve the safety and reliability of the display device 10 by more sensitively detecting the abnormal current level of the gate clock current CKV_C.

Figure 9:
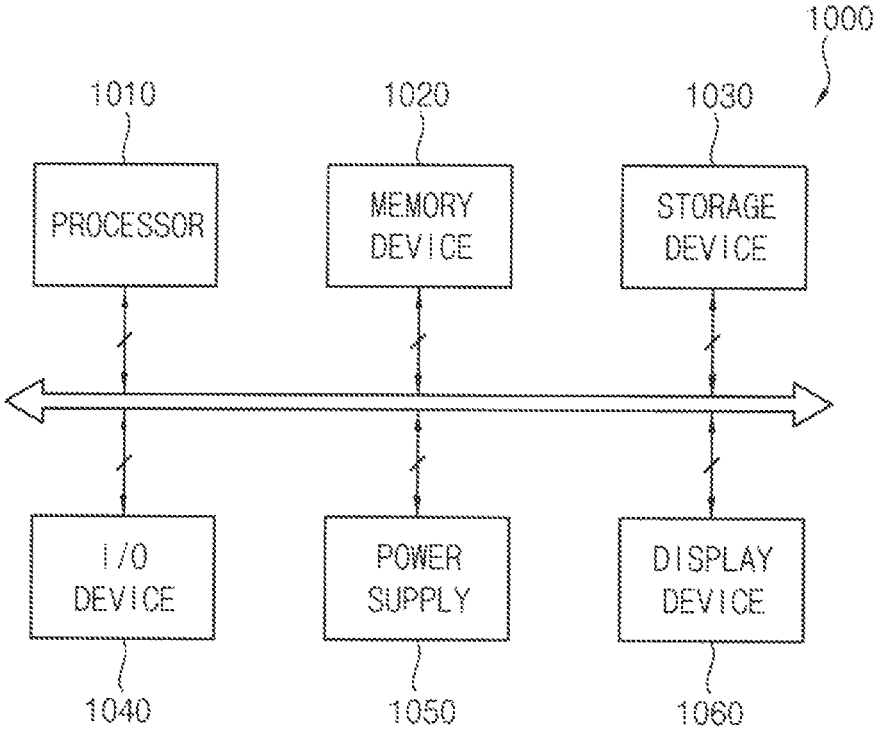
FIG. 9 is a block diagram illustrating an electronic device according to an embodiment of the present inventive concept.
Figure 10:
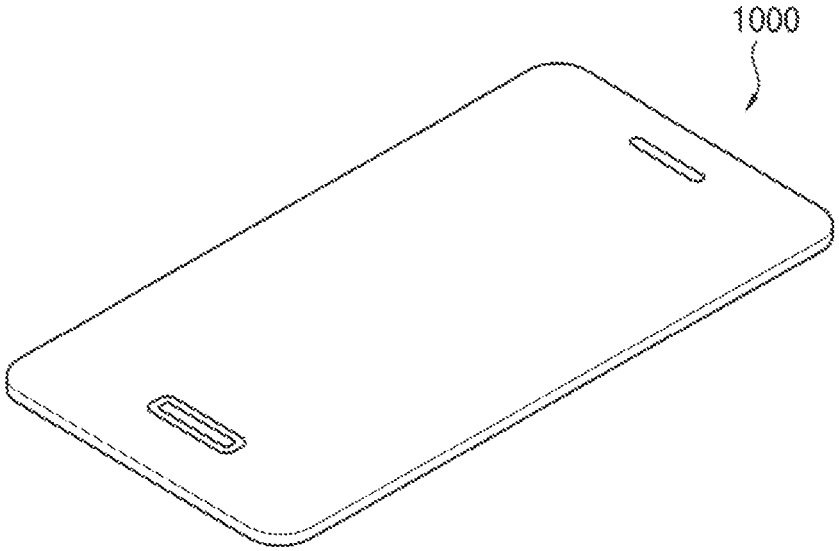
FIG. 10 is a diagram illustrating an example in which the electronic device of FIG. 9 is implemented as a smartphone.

FIG. 9 is a block diagram illustrating an electronic device 1000 according to an embodiment of the present inventive concept. FIG. 10 is a diagram illustrating an example in which the electronic device 1000 of FIG. 9 is implemented as a smartphone.

Referring to FIGS. 9 and 10, the electronic device 1000 may include a processor 1010, a memory device 1020, a storage device 1030, an input/output (I/O) device 1040, a power supply 1050, and a display device 1060. In addition, the electronic device 1000 may further include a plurality of ports for communicating with a video card, a sound card, a memory card, a universal serial bus (USB) device, other electronic device, and the like. In an embodiment, as illustrated in FIG. 10, the electronic device 1000 may be implemented as a smart phone. However, in an embodiment, the electronic device 1000 may be implemented as a cellular phone, a video phone, a smart pad, a smart watch, a tablet PC, a car navigation system, a computer monitor, a laptop, a head mounted display (HMD) device, and the like.

The processor 1010 may perform various computing functions. The processor 1010 may be a micro processor, a central processing unit (CPU), an application processor (AP), and the like. The processor 1010 may be coupled to other components via an address bus, a control bus, a data bus, and the like. Further, the processor 1010 may be coupled to an extended bus such as a peripheral component interconnection (PCI) bus. The memory device 1020 may store data for operations of the electronic device 1000. For example, the memory device 1020 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and the like and/or at least one volatile memory device such as a dynamic random access memory (DRAM) device, a static random access memory (SRAM) device, a mobile DRAM device, and the like. The storage device 1030 may include a solid state drive (SSD) device, a hard disk drive (HDD) device, a CD-ROM device, and the like. The I/O device 1040 may include an input device such as a keyboard, a keypad, a mouse device, a touch-pad, a touch-screen, and the like, and an output device such as a printer, a speaker, and the like. In some embodiments, the I/O device 1040 may include the display device 1060. The power supply 1050 may provide power for operations of the electronic device 1000.

The display device 1060 may display an image corresponding to visual information of the electronic device 1000. The display device 1060 may include a display panel, a gate driver, a data driver, and a power voltage generator. The display panel includes a gate line, a data line, and a pixel electrically connected to the gate line and the data line, and is configured to display an image based on input image data. The gate driver is configured to output a gate signal to the gate line. The data driver is configured to output a data voltage to the data line. The power voltage generator is configured to generate a gate-on voltage, a gate-off voltage, and a gate clock signal toggled between the gate-on voltage and the gate-off voltage, detect a current level of a gate clock current based on the gate clock signal, and cut off power of the display device when a count of the gate clock current higher than or equal to a first current level is greater than or equal to a reference count. The power voltage generator may cut off the power of the display device when the gate clock current is higher than or equal to a second current level higher than the first current level in an initial frame after the display device is turned on. The display device detects an abnormal current level of a gate clock current after the display device is turned on, and cuts off the power of the display device when an overcurrent occurs, so that the display device may prevent a malfunction of the display panel. In addition, the display device may prevent the display device from being heated up due to high heat, and reduce risks such as fire. As a result, the display device of the present inventive concept can improve the safety and the reliability of the display device.

The foregoing is illustrative of the present inventive concept and is not to be construed as limiting thereof. Although a few embodiments of the present inventive concept have been described, those skilled in the art will readily appreciate that many modifications are possible in the embodiments without materially departing from the novel teachings and advantages of the present inventive concept. Accordingly, all such modifications are intended to be included within the scope of the present inventive concept as defined in the claims. In the claims, any means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific embodiments disclosed, and that modifications to the disclosed embodiments, as well as other embodiments, are intended to be included within the scope of the appended claims. The present inventive concept is defined by the following claims, with equivalents of the claims to be included therein.

What is claimed is:

1. A display device comprising:

a display panel comprising a gate line, a data line, and a pixel electrically connected to the gate line and the data line, the display panel configured to display an image based on input image data;

a gate driver configured to output a gate signal to the gate line;

a data driver configured to output a data voltage to the data line; and a power voltage generator configured to:

generate a gate-on voltage, a gate-off voltage, and a gate clock signal toggled between the gate-on voltage and the gate-off voltage;

detect a current level of a gate clock current immediately before a rising edge of the gate clock signal while the gate clock signal has the gate-off voltage;

detect a current level of the gate clock current immediately before a falling edge of the gate clock signal while the gate clock signal has the gate-on voltage;

cut off power of the display device when a count of the gate clock current higher than or equal to a first current level is greater than or equal to a reference count; and cut off the power of the display device when the gate clock current is higher than or equal to a second current level higher than the first current level in an initial frame after the display device is turned on.

2. The display device of claim 1, wherein the power voltage generator simultaneously activates a first cut-off mode which cuts off the power of the display device when the count of the gate clock current higher than or equal to the first current level is greater than or equal to the reference count, and a second cut-off mode which cuts off the power of the display device when the gate clock current is higher than or equal to the second current level in the initial frame after the display device is turned on.

3. The display device of claim 2, wherein the power voltage generator comprises:

a voltage generator which receives a power voltage and a clock control signal, and converts and outputs the clock control signal into the gate clock signal; and an overcurrent detector which detects the gate clock current flowing through a voltage terminal to output an overcurrent detection signal.

4. The display device of claim 3, wherein the overcurrent detector comprises:

a current sensor for sensing the gate clock current output through the voltage terminal;

an overcurrent detection circuit for determining whether the gate clock current is higher than or equal to a reference current level;

an overcurrent counter for counting the count of the gate clock current higher than or equal to the reference current level; and an overcurrent determination circuit for determining that the gate clock current is in an overcurrent state when the count counted by the overcurrent counter is greater than equal to the reference count.

5. The display device of claim 4, wherein the overcurrent determination circuit activates the overcurrent detection signal when the gate clock current is determined to be in the overcurrent state.

6. The display device of claim 5, wherein the voltage generator cuts off the power of the display device when the overcurrent detection signal is activated.

7. The display device of claim 2, wherein the first current level and the second current level are settable.

8. The display device of claim 2, wherein the reference count is settable.

9. A method of driving a display device, the method comprising:

generating a gate-on voltage and a gate-off voltage;

generating a gate clock signal toggled between the gate-on voltage and the gate-off voltage;

detect a current level of a gate clock current immediately before a rising edge of the gate clock signal while the gate clock signal has the gate-off voltage;

detect a current level of the gate clock current immediately before a falling edge of the gate clock signal while the gate clock signal has the gate-on voltage;

cutting off power of a display device when a count of the gate clock current higher than or equal to a first current level is greater than or equal to a reference count; and cutting off the power of the display device when the gate clock current is higher than or equal to a second current level higher than the first current level in an initial frame after the display device is turned on.

10. The method of claim 9, wherein a first cut-off mode which cuts off the power of the display device when the count of the gate clock current higher than or equal to the first current level is greater than or equal to the reference count, and a second cut-off mode which cuts off the power of the display device when the gate clock current is higher than or equal to the second current level in the initial frame after the display device is turned on are simultaneously activated.

11. The method of claim 10, wherein the cutting off of the power of the display device further comprises:

receiving a power voltage and a clock control signal, and converting and outputting the clock control signal into the gate clock signal; and detecting the gate clock current flowing through a voltage terminal and outputting an overcurrent detection signal.

12. The method of claim 11, wherein the outputting of the overcurrent detection signal comprises:

sensing the gate clock current output through the voltage terminal;

determining whether the gate clock current is higher than or equal to a reference current level;

counting the count of the gate clock current higher than or equal to the reference current level; and determining that the gate clock current is in an overcurrent state when the count of the gate clock current higher than or equal to the reference current level is greater than equal to the reference count.

13. The method of claim 12, wherein the outputting of the overcurrent detection signal further comprises:

activating the overcurrent detection signal when the gate clock current is determined to be in the overcurrent state.

14. The method of claim 13, wherein the converting and outputting of the clock control signal into the gate clock signal comprises:

cutting off the power of the display device when the overcurrent detection signal is activated.

15. The method of claim 10, wherein the first current level and the second current level are settable.

16. The method of claim 10, wherein the reference count is settable.

* * * * *